US012102201B2

(12) United States Patent
Chen

(10) Patent No.: US 12,102,201 B2
(45) Date of Patent: Oct. 1, 2024

(54) SUITCASE WITH GARMENT BAG

(71) Applicant: Guanyu Chen, Guangzhou (CN)

(72) Inventor: Guanyu Chen, Guangzhou (CN)

( * ) Notice: Subject to any disclaimer, the term of this patent is extended or adjusted under 35 U.S.C. 154(b) by 316 days.

(21) Appl. No.: 17/809,028

(22) Filed: Jun. 27, 2022

(65) Prior Publication Data

US 2023/0380562 A1 Nov. 30, 2023

(30) Foreign Application Priority Data

May 30, 2022 (CN) ..... 202221323770.6

(51) Int. Cl.
*A45C 13/03* (2006.01)
*A45C 5/14* (2006.01)
*A45C 13/10* (2006.01)

(52) U.S. Cl.
CPC ..... *A45C 13/03* (2013.01); *A45C 5/14* (2013.01); *A45C 13/10* (2013.01)

(58) Field of Classification Search
CPC ..... A45C 13/03; A45C 5/14; A45C 13/10; A45C 3/004; A45C 13/103
See application file for complete search history.

(56) References Cited

U.S. PATENT DOCUMENTS 4,662,513 A * 5/1987 King ..... A45C 3/004 190/111
5,566,797 A * 10/1996 Van Himbeeck ..... A45C 3/004 190/102
5,575,391 A * 11/1996 Gerch ..... A45C 5/14 190/115
D566,964 S * 4/2008 Greiner ..... D3/293
7,861,857 B2 * 1/2011 Vorderkunz ..... A45C 13/03 206/289
2002/0139627 A1 * 10/2002 Mahanavanont ..... A45C 3/004 190/115
2018/0279734 A1 * 10/2018 Kao ..... A45C 5/14
2019/0307215 A1 * 10/2019 Sharp ..... A45C 5/14
2021/0307467 A1 * 10/2021 Hersh ..... A45C 7/0077

* cited by examiner

*Primary Examiner* — Don M Anderson
*Assistant Examiner* — Justin Caudill
(74) *Attorney, Agent, or Firm* — Daniel M. Cohn; Howard M. Cohn

(57) ABSTRACT

A suitcase with a garment bag includes a suitcase body. One side of the suitcase body extends upward to form a suitcase cover. The garment bag is arranged in the suitcase body and is detachably connected with the suitcase body. The suitcase cover is connected with the suitcase body through a first zipper. The first zipper is configured to open and close the suitcase. A first movable connecting piece is arranged on an inner side of the suitcase cover. A second movable connecting piece arranged on an upper end of the garment bag is movably connected with the first movable connecting piece. The second movable connecting piece is corresponding to the first movable connecting piece. First binding components are arranged on the inner side of the suitcase cover. A position of the first binding components is corresponding to a waist portion of the garment bag.

12 Claims, 7 Drawing Sheets

SUITCASE WITH GARMENT BAG

CROSS-REFERENCE TO RELATED APPLICATION(S)

This application claims priority of Chinese Patent Application No. 202221323770.6, filed on May 30, 2022, the entire contents of which are incorporated herein by reference.

TECHNICAL FIELD

The present disclosure relates to a technical field of suitcase technology, and in particular to a suitcase with a garment bag.

BACKGROUND

Suitcases are generally configured for travel and home storage at ordinary times. Garment bags are generally configured to store business suits. Conventional garment bags are generally used separately. When the business suits are hung in a wardrobe at home, the business suits are flatly hung by a user. However, if the user want to travel, the business suits are often folded and placed in a suitcase, which is easy to cause wrinkles in the business suits. For expensive business suits, an appearance of wrinkles will affect the image of the user, so it takes effort to maintain and organize the business suits. If the garment bag is carried separately, it is inconvenient to carry due to heavy weight. Therefore, the present disclosure provides a suitcase with a garment bag, which is used as a suitcase and realizes the detachable mounting of the garment bag. It effectively protects the business suits from wrinkling and is convenient to carry when the user travels with the business suits, which is very practical.

SUMMARY

In order to overcome deficiencies in the prior art, purpose of the present disclosure is to provide a suitcase with a garment bag to solve technical problems mentioned in the prior art.

To solve the technical problems, the present disclosure provides a suitcase with a garment bag.

The suitcase with the garment bag comprises a suitcase body. One side of the suitcase body extends upward to form a suitcase cover. The garment bag is arranged in the suitcase body. The garment bag is detachably connected with the suitcase body. The suitcase cover is connected with the suitcase body through a first zipper. The first zipper is configured to open and close the suitcase. A first movable connecting piece is arranged on an inner side of the suitcase cover. A second movable connecting piece arranged on an upper end of the garment bag is movably connected with the first movable connecting piece. A position of the second movable connecting piece is corresponding to a position of the first movable connecting piece. First binding components are arranged on the inner side of the suitcase cover. A position of the first binding components is corresponding to a waist portion of the garment bag.

Furthermore, both of the first movable connecting piece and the second movable connecting piece are selected from a hook and loop fastener, a movable buckle, a snap fastener, or a connecting buckle.

Furthermore, the first binding components are selected from elastic corset belts, adjustable webbing belts or non-adjustable webbing belts. The first binding components bind the waist portion of the garment bag and prevent the garment bag from being deformed when the suitcase cover is closed. The first binding components are connected through first snap fasteners.

Furthermore, the first zipper is a U-shaped zipper. The first zipper extends from a first end of a rear portion of the suitcase body to a second end of the rear portion of the suitcase body along the suitcase cover. The suitcase cover extends from the rear portion of the suitcase body to a front portion of the suitcase body.

Furthermore, the garment bag comprises a top curtain arranged at a top portion of the garment bag, a left curtain, and a right curtain. The left curtain and the right curtain are arranged under the top curtain. The top curtain is bonded to a bag body of the garment bag through Velcro. The left curtain is detachably connected with the right curtain through a second zipper. At least one hanging ring is arranged on an upper end of an inner side of the bag body. The at least one hanging ring is configured to hang a business suit; second binding components configured to limits a position of the business suit are arranged below the at least one hanging ring.

Furthermore, the second binding components are elastic belts or adjustable belts. The second binding components are connected by second snap fasteners.

Furthermore, a first handle is arranged on an upper end of the suitcase body. Stabilizing belts are arranged adjacent to two sides of the first handle. The stabilizing belts prevent excessive pulling of the suitcase cover when carrying the suitcase. The stabilizing belts are connected through third snap fasteners.

Furthermore, second handles are respectively arranged on an upper end and a lower end of an outer side of the bag body. The second handles are configured to directly lift the garment bag. A hook is arranged the upper end of the outer side of the bag body. A tie storage pocket is arranged on one side of the top curtain. The tie storage pocket is opened or closed by a third zipper.

Furthermore, at least one hidden pocket is arranged on the left curtain or the right curtain. The at least one hidden pocket is opened and closed through a fourth zipper. A net pocket is arranged adjacent to the at least one hidden pocket.

Furthermore, the suitcase body further comprises a pulling rod and universal wheels. The pulling rod is installed on one side of the suitcase cover. The universal wheels are installed at a bottom portion of the suitcase body. A combination lock is arranged on another side of the suitcase body.

Compared with the prior art, in the present disclosure, the suitcase is configured to storage as a normal suitcase, and the suitcase is able to be equipped with the garment bag to carry the business suit, which ensures that the business suit is effectively protected.

By arranging the first binding components on the inner side of the suitcase cover, it is ensured that the garment bag does not collapse or deform in the suitcase when the suitcase cover is closed by the first zipper.

By arranging the stabilizing belts, the suitcase cover is prevented from being pulled too much when carrying the suit case. Meanwhile, the stabilizing belts further prevent deformation of the garment bag arranged in the suitcase body.

Suitcase body—1; suitcase cover—2; garment bag—3; first zipper—4; first movable connecting piece—5; second movable connecting piece—6; first binding component—7; top curtain—8; left curtain—9; right curtain—10; second zipper—11; hanging ring—12; second binding component 13; second snap fasteners—14; first handle—15; stabilizing belt—16; third snap fasteners—17; second handle—18; hook—19; tie storage pocket—20; third zipper—21; hidden pocket—22; fourth zipper—23; net pocket—24; pulling rod—25; universal wheel—26; combination lock—27; first snap fasteners—28.

DETAILED DESCRIPTION

The present disclosure will be further described with reference to the accompanying drawings and specific embodiments. It should be noted that, on the premise of no conflict, the embodiments or technical features described below can be arbitrarily combined to form new embodiments.

Figure 1:
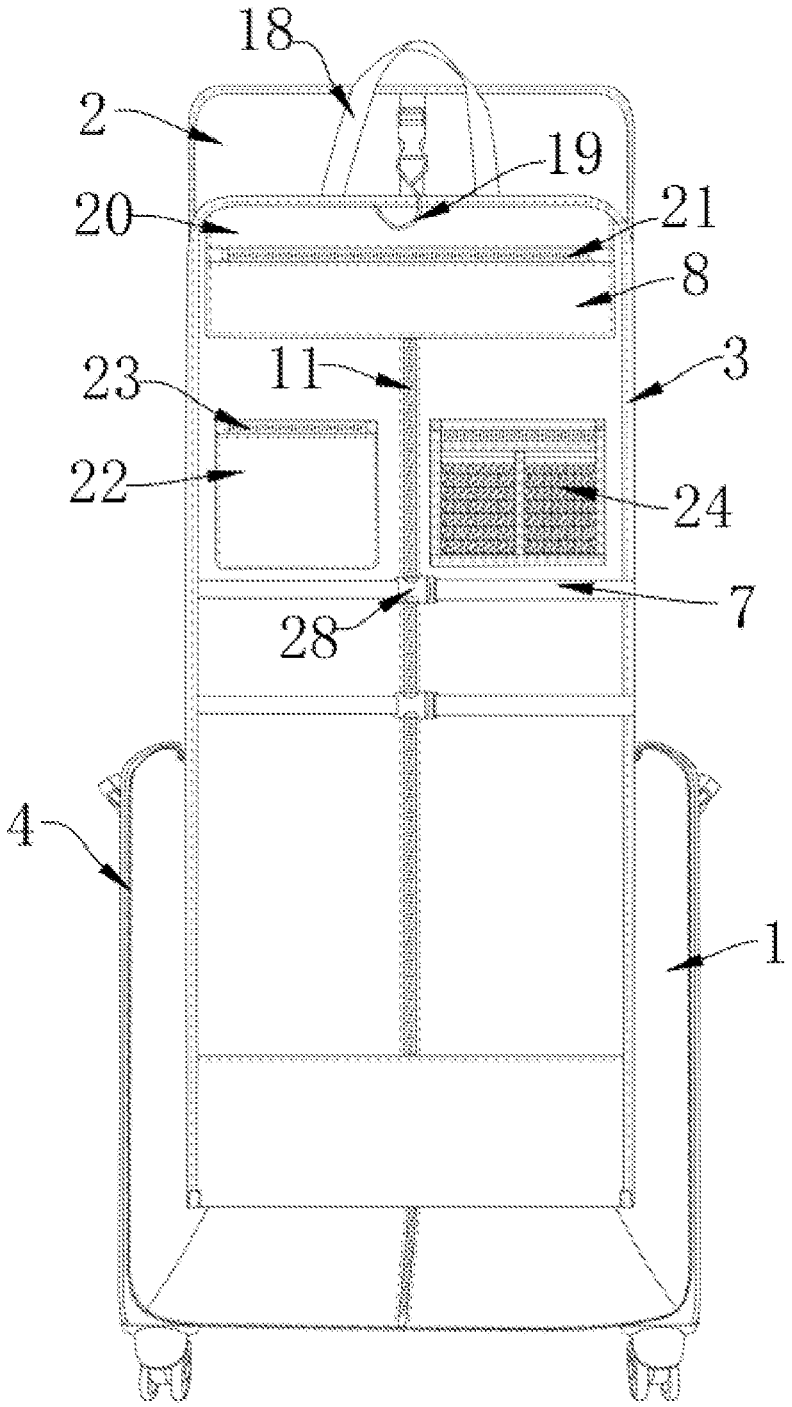
FIG. 1 is a schematic diagram of a suitcase with a garment bag of the present disclosure where the garment bag is connected with a suitcase body.
Figure 2:
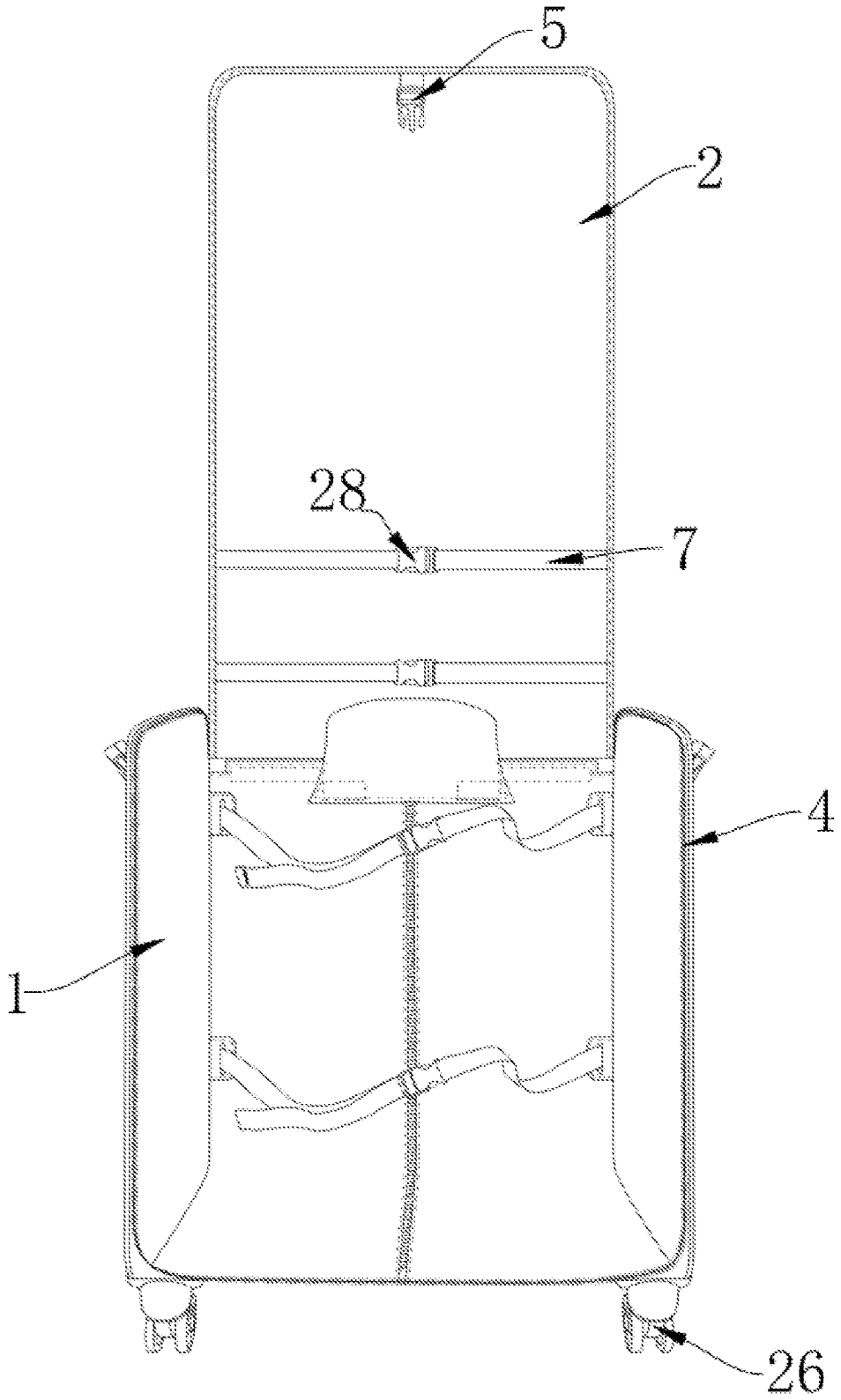
FIG. 2 is a schematic diagram of the suitcase body and a suitcase cover.
Figure 3:
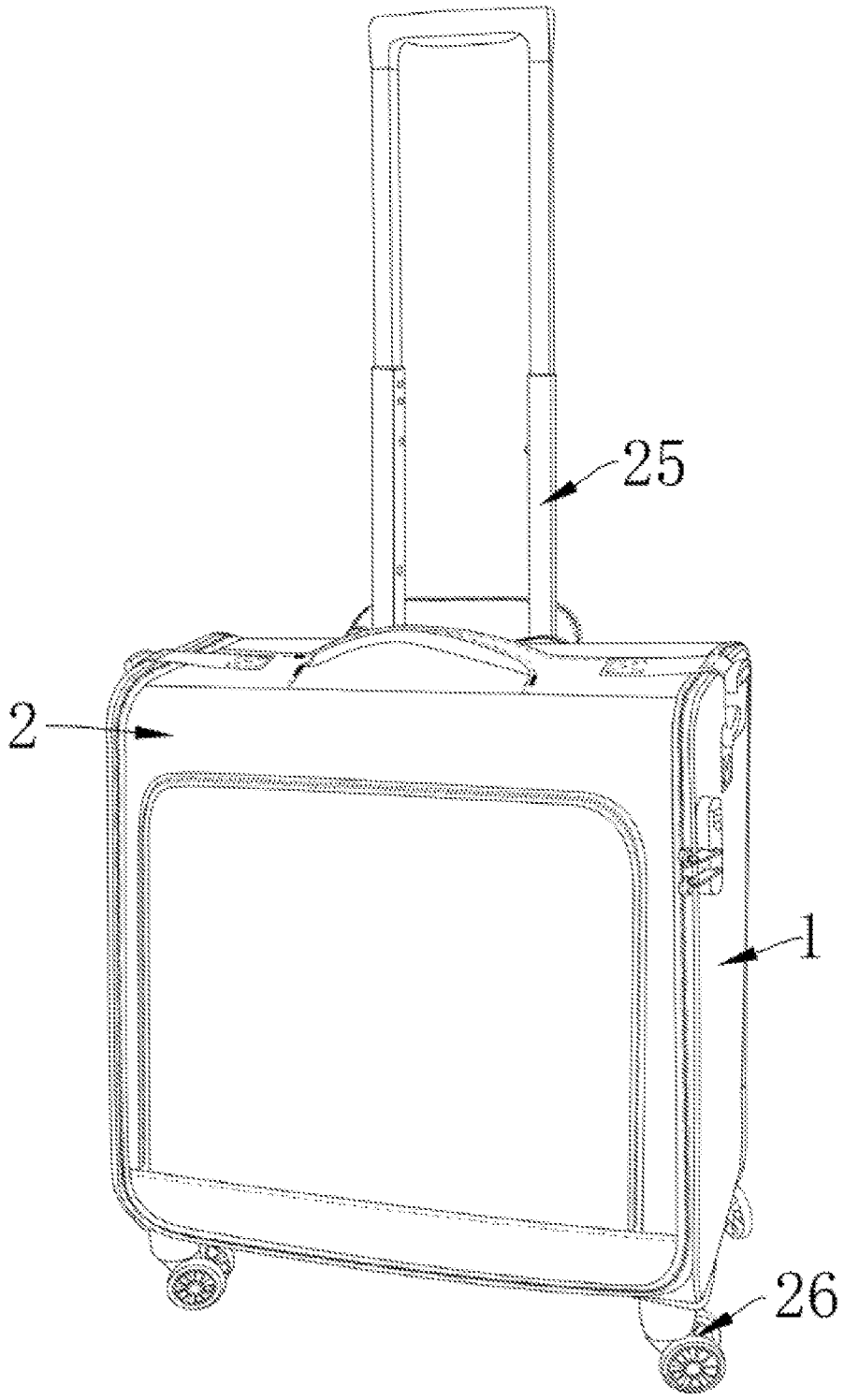
FIG. 3: is a schematic diagram of the suitcase with the garment bag of the present disclosure where the suitcase is equipped with a pulling rod.
Figure 4:
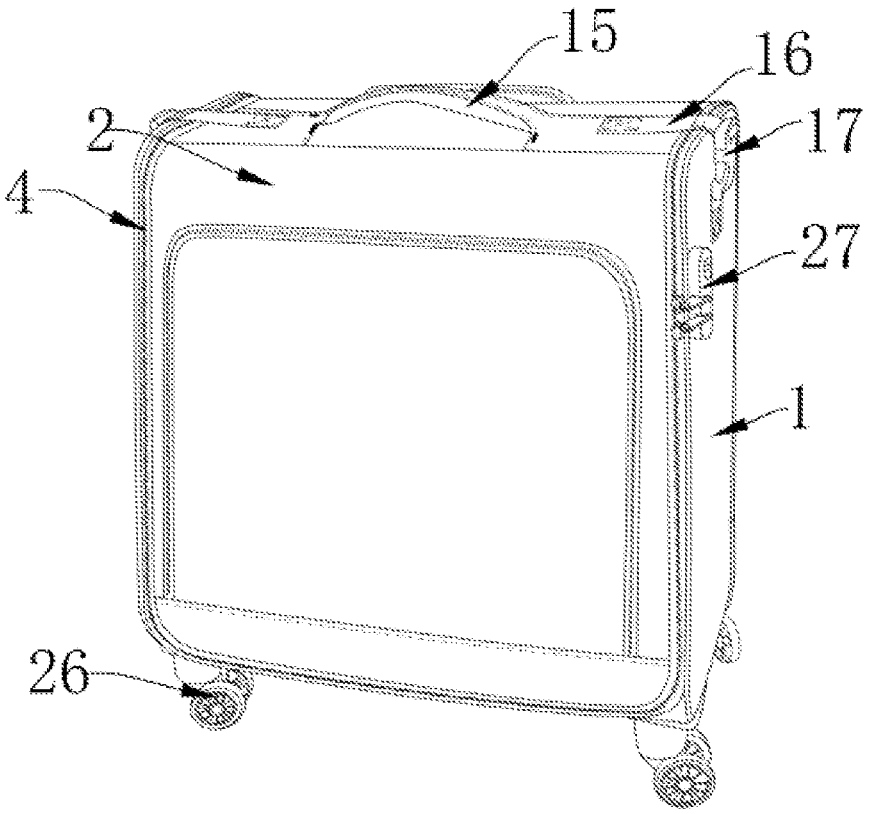
FIG. 4: is a schematic diagram of the suitcase with the garment bag of the present disclosure where the suitcase cover is covered on the suitcase body through a first zipper and the stabilizing belts are connected by third snap fasteners.
Figure 5:
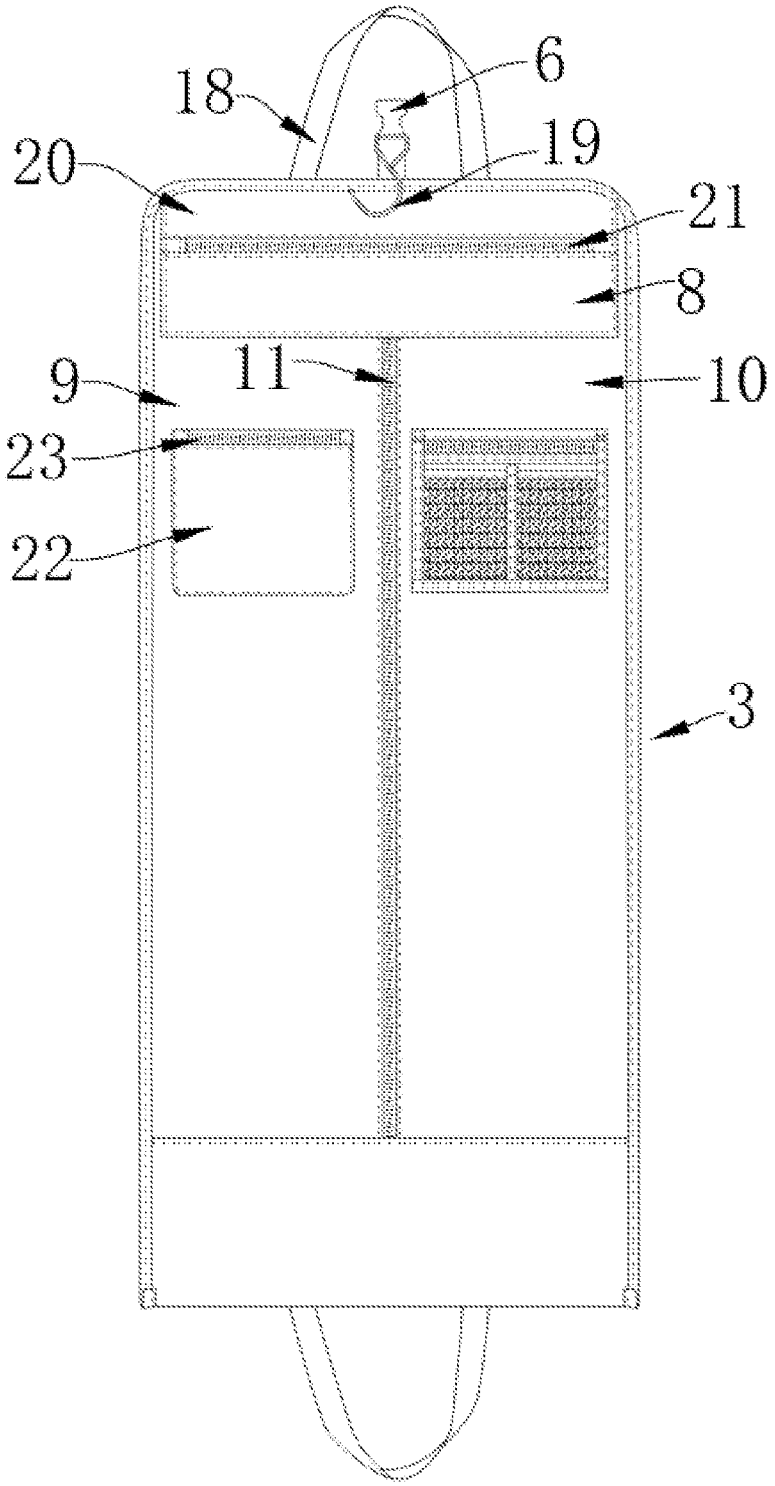
FIG. 5: is a schematic diagram of the garment bag of the present disclosure shown in a closed state.
Figure 6:
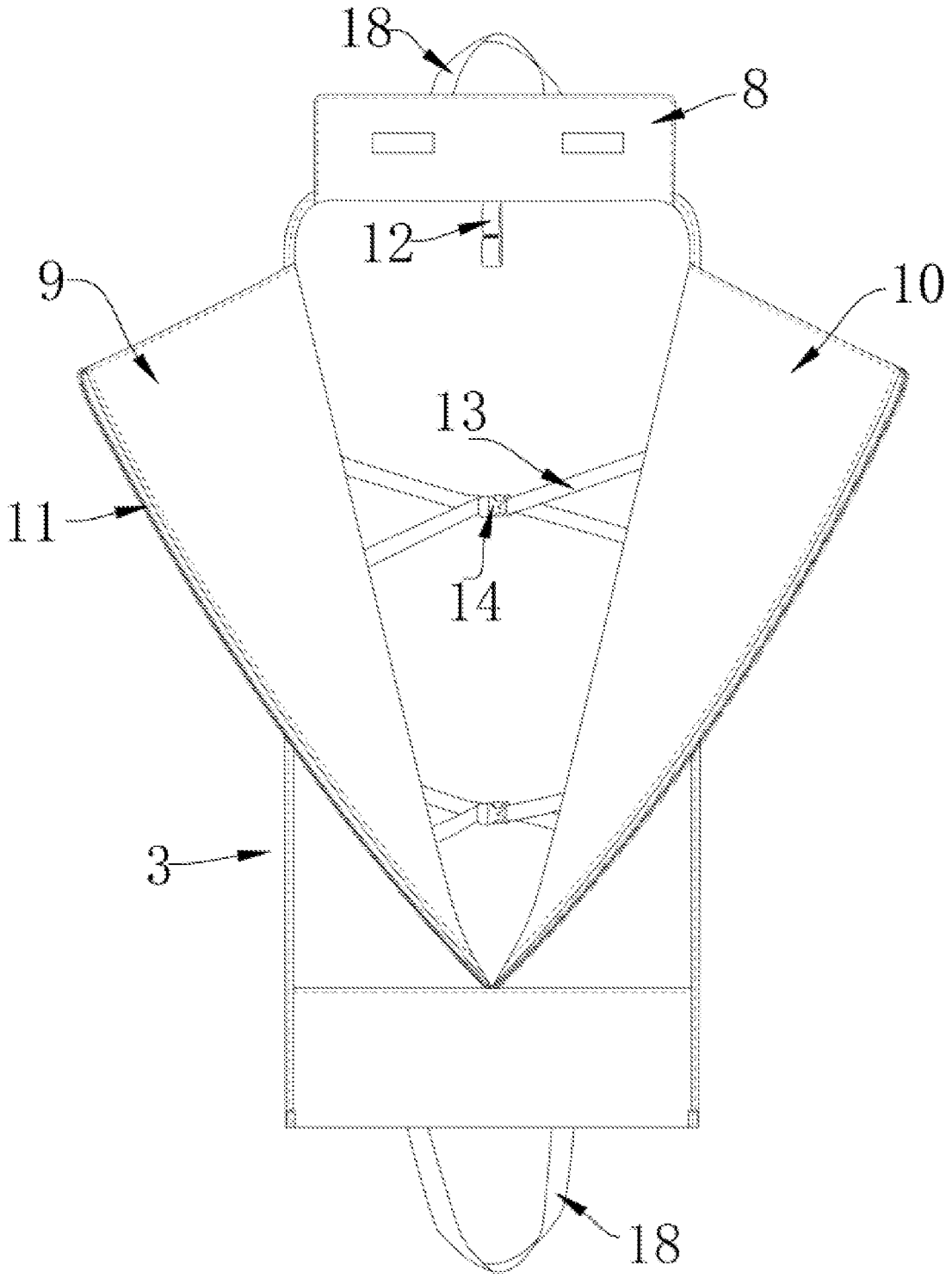
FIG. 6: is a schematic diagram of the garment bag of the present disclosure shown in an open state.
Figure 7:
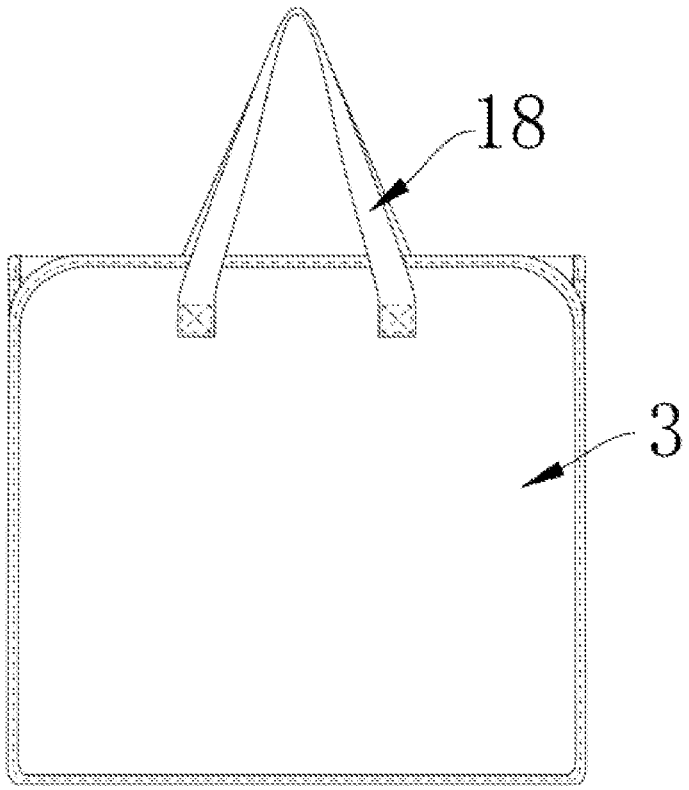
FIG. 7: is a schematic diagram of the garment bag of the present disclosure shown in a folded state.
Figure 8:
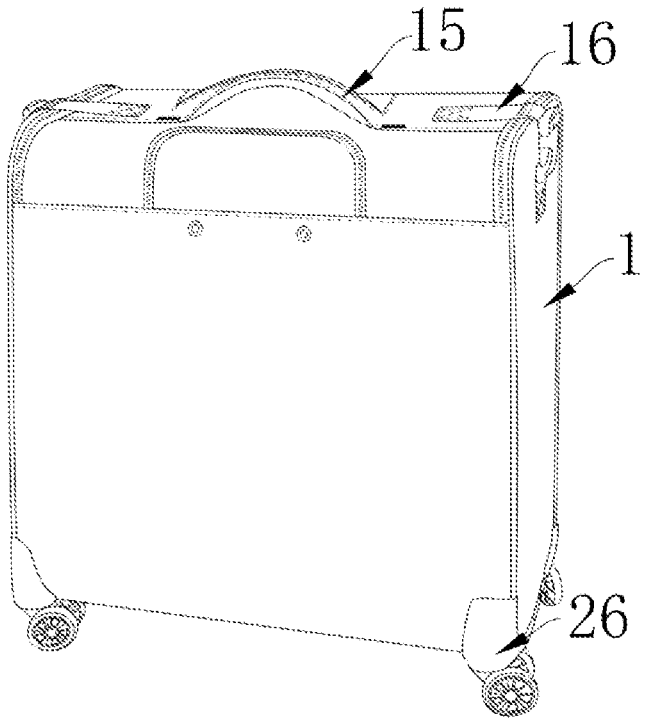
FIG. 8 is a rear perspective schematic diagram of the suitcase with the garment bag of the present disclosure.

As shown in FIGS. 1-8, the present disclosure provides a suitcase with a garment bag 3.

The suitcase with the garment bag 3 comprises a suitcase body 1. One side of the suitcase body 1 extends upward to form a suitcase cover 2. The garment bag is 3 arranged in the suitcase body 1. The garment bag 3 is detachably connected with the suitcase body 1. The suitcase cover 2 is connected with the suitcase body 1 through a first zipper 4. The first zipper 4 is configured to open and close the suitcase. A first movable connecting piece 5 is arranged on an inner side of the suitcase cover 2. A second movable connecting piece 6 arranged on an upper end of the garment bag is movably connected with the first movable connecting piece 5. A position of the second movable connecting piece 6 is corresponding to a position of the first movable connecting piece 5. First binding components 7 are arranged on the inner side of the suitcase cover 2. A position of the first binding components 7 is corresponding to a waist portion of the garment bag 3. Specifically, the suitcase cover 2 that is rectangular extends upward from the rear portion of the suitcase body 1. Two sides of the suitcase cover are connected with two sides of the suitcase body 1 by the first zipper 4. Specifically, both of the first movable connecting piece and the second movable connecting piece are selected from a hook and loop fastener, a movable buckle, a snap fastener, or a connecting buckle. Optionally, the first movable connecting piece and the second movable connecting piece are movable buckles, which are convenient for detachment of the garment bag 3. After use, the first movable connecting piece and the second movable connecting piece are connected with each other.

Specifically, the first binding components 7 are selected from elastic corset belts, adjustable webbing belts or non-adjustable webbing belts. The first binding components 7 bind the waist portion of the garment bag 3 and prevent the garment bag 3 from being deformed when the suitcase cover 2 is closed. Optionally, the first binding components 7 are non-adjustable webbing belts and the first binding components are connected through first snap fasteners 28.

Specifically, the first zipper 4 is a U-shaped zipper. The first zipper extends from a first end of the rear portion of the suitcase body 1 to a second end of the rear portion of the suitcase body 1 along the suitcase cover 2. The suitcase cover 2 extends from the rear portion of the suitcase body 1 to a front portion of the suitcase body 1. In the embodiment, the first zipper is arranged along an edge of the suitcase cover 2.

Specifically, the garment bag 3 comprises a top curtain 8 arranged at a top portion of the garment bag 3, a left curtain 9, and a right curtain 10. The left curtain 9 and the right curtain 10 are arranged under the top curtain 8. The top curtain 8 is bonded to a bag body of the garment bag 3 through Velcro. The left curtain 9 is detachably connected with the right curtain 10 through a second zipper 11. The second zipper 11 extends from top portions to bottom portions of the left curtain 9 and the right curtain 10. Specifically, the number of the hanging rings 12 may be two, three or more. In one embodiment, the hanging rings 12 are arranged in an array up and down along a height direction of the garment bag 3, so that three sets, or four sets or even multiple sets of business suits are hung at the same time. When in use, the top curtain 8 is opened and the second zipper 11 is unzipped, then the business suit is put on a hanger. Then a hanger hook of the hanger is hooked on one of the hanging rings 12, and a lower end of the business suit is put into the garment bag 3 by lifting the left curtain and the right curtain, and then second binding components 13 are connected to prevent the business suit from moving in the garment bag 3, In addition, the second binding components 13 are elastic belts or adjustable belts. The second binding components 13 are connected by second snap fasteners 14. If the second binding components 13 are of a cross type, the second binding components 13 are X-shaped second binding components after they are buckled with each other. If the second binding components 13 are of a parallel type, the second binding components 13 are horizontal second binding components after they are buckled with each other. In the embodiment, two or three pair of the second binding components 13 are provided and the second binding components 13 are arranged in an array from top to bottom along the garment bag 3.

Specifically, in order to be able to travel with the suitcase, a first handle 15 is arranged on an upper end of the suitcase body 1. Stabilizing belts 16 are arranged adjacent to two sides of the first handle 15. The stabilizing belts 16 prevent excessive pulling of the suitcase cover 2 when carrying the suitcase. The stabilizing belts 15 are connected through third snap fasteners 17. The first handle 15 is arranged on the rear portion of the suitcase cover 2. After the suitcase cover 2 is closed, the first handle 15 is located on a top of the suitcase body 1 of the suitcase, which is convenient for lifting.

Each of the stabilizing belts 16 comprises two sections. A first section of each of the stabilizing belts is arranged on the suitcase cover 2, and a second section of each of the stabilizing belts is arranged on one side of the suitcase body 1. When the first handle 15 is not lifted, the two sections of each of the stabilizing belts 16 are not buckled. When the suitcase needs to be lifted, two sections of each of the stabilizing belts 16 are buckled with each other, which prevent the suitcase cover 2 from being pulled excessively, prevent the shape of the garment bag 3 from deformation in the suitcase, and prevent excessive deformation of the suitcase.

In order to separately carry out the garment bag 3, second handles 18 are respectively arranged on an upper end and a lower end of an outer side of the bag body, which are convenient for lifting the garment bag 3. A hook 19 is arranged the upper end of the outer side of the bag body, so that the garment bag 3 is directly hung on a cloth rail to change clothes when it is carried to a certain place. For the user who wear the business suit, he generally needs to wear a tie . . . . In the present disclosure, a tie storage pocket 20 is arranged on one side of the top curtain 8. The tie storage pocket 20 is opened or closed by a third zipper 21.

Specifically, in order to increase the storage function of the garment bag 3, at least one hidden pocket 22 is arranged on the left curtain 9 or the right curtain 10. The at least one hidden pocket 22 is opened and closed through a fourth zipper 23. A net pocket 24 is arranged adjacent to the at least one hidden pocket 22. The net pocket 24 is configured to storage pens or other small objects.

Specifically, in another embodiment, the suitcase body 1 further comprises a pulling rod 25 and universal wheels 26. The pulling rod 25 is installed on one side of the suitcase cover 2. The universal wheels 25 are installed at a bottom portion of the suitcase body 1. A combination lock 27 is arranged on another side of the suitcase body 1. At least one zipper puller of the first zipper 4 is locked on the combination lock 27. The embodiment provides the suitcase with the pulling rod. Compared with the aforementioned embodiments, the suitcase with the pulling rod is convenient to push and pull, which save time and energy during carrying.

A use method of the suitcase with the garment bag of the present disclosure is as follow:

Step 1: One business suit is put into the garment bag. Specifically, the top curtain 8 is opened and the second zipper 11 is unzipped, then the business suit is put on the hanger. Then, the hanger hook of the hanger is hooked on one of the hanging rings 12, and the lower end of the business suit is put into the garment bag 3 by lifting the left curtain 9 and the right curtain 10, and then second binding components 13 are connected to prevent the business suit from moving in the garment bag 3, Then the second zipper 11 is zipped to connected the left curtain with the right curtain and the top curtain 8 is attached to the left curtain 9 and the right curtain 10. If the user needs to put the tie, the third zipper 21 is unzipped to put the tie in the tie storage pocket.

Step 2: The garment bag 3 is put into the suitcase. Specifically, the first zipper 4 is unzipped to open the suitcase cover 2, and the second movable connecting piece 6 of the garment bag 3 is found and the position of the second movable connecting piece is made to be corresponding to the position of the movable connecting piece on the suitcase cover 2. Then the first movable connecting piece is connected with the second movable connecting piece. The first binding components 7 (buckling webbing belts) arranged on the lower portion of the inner side of the suitcase cover 2 are found, and then the waist portion of the garment bag 3 is bound through the first binding components 7. Later, the suitcase cover 2 is covered on the suitcase body 1 and the first zipper 4 is zipped to close the suitcase. If the user needs to use the first handle 15, the two sections of each of the stabilizing belts 16 are buckled with each other. Of course, the stabilizing belts 16 may not be connected if the user does not mind of deformation of the suitcase. Even the stabilizing belts 16 are not connected, the suitcase is able to be pushed and pulled.

The above steps are about a process of putting the business suit into the garment bag 3 and then putting the garment bag 3 into the suitcase. If the user wants to take out the business suit when the user reach a certain place, the user is able to perform opposite steps to take out the business suit . . . .

The above embodiments are only optional embodiments of the present disclosure and are not intended to limit the protection scope of the present disclosure. Any unsustainable change and replacement made by those skilled in the art on the basis of the present disclosure should fall within the protection scope of the present disclosure.

What is claimed is:

1. A suitcase with a garment bag, comprising: a suitcase body; wherein one side of the suitcase body extends upward to form a suitcase cover; the garment bag is arranged in the suitcase body; the garment bag is detachably connected with the suitcase body; the suitcase cover is connected with the suitcase body through a first zipper; the first zipper is configured to open and close the suitcase; a first movable connecting piece is arranged on an inner side of the suitcase cover; a second movable connecting piece arranged on an upper end of the garment bag is movably connected with the first movable connecting piece; a position of the second movable connecting piece is corresponding to a position of the first movable connecting piece; first binding components are arranged on the inner side of the suitcase cover; a position of the first binding components is corresponding to a waist portion of the garment bag.

2. The suitcase with the garment bag according to claim 1, wherein both of the first movable connecting piece and the second movable connecting piece are selected from a hook and loop fastener, a movable buckle, a snap fastener, or a connecting buckle.

3. The suitcase with the garment bag according to claim 1, wherein the first binding components are selected from elastic corset belts, adjustable webbing belts or non-adjustable webbing belts; the first binding components bind the waist portion of the garment bag and prevent the garment bag from being deformed when the suitcase cover is closed; the first binding components are connected through first snap fasteners.

4. The suitcase with the garment bag according to claim 1, wherein the first zipper is a U-shaped zipper; the first zipper extends from a first end of a rear portion of the suitcase body to a second end of the rear portion of the suitcase body along the suitcase cover; the suitcase cover extends from the rear portion of the suitcase body to a front portion of the suitcase body.

5. The suitcase with the garment bag according to claim 1, wherein the garment bag comprises a top curtain arranged at a top portion of the garment bag, a left curtain, and a right curtain; the left curtain and the right curtain are arranged under the top curtain; the top curtain is bonded to a bag body of the garment bag through Velcro; the left curtain is detachably connected with the right curtain through a second zipper; at least one hanging ring is arranged on an upper end of an inner side of the bag body; the at least one hanging ring is configured to hang a business suit; second binding components configured to limits a position of the business suit are arranged below the at least one hanging ring.

6. The suitcase with the garment bag according to claim 5, wherein the second binding components are elastic belts or adjustable belts; the second binding components are connected by second snap fasteners.

7. The suitcase with the garment bag according to claim 1, wherein a first handle is arranged on an upper end of the suitcase body; stabilizing belts are arranged adjacent to two sides of the first handle; the stabilizing belts prevent excessive pulling of the suitcase cover when carrying the suitcase; the stabilizing belts are connected through third snap fasteners.

8. The suitcase with the garment bag according to claim 5, wherein second handles are respectively arranged on an upper end and a lower end of an outer side of the bag body; the second handles are configured to directly lift the garment bag; a hook is arranged the upper end of the outer side of the bag body; a tie storage pocket is arranged on one side of the top curtain; the tie storage pocket is opened or closed by a third zipper.

9. The suitcase with the garment bag according to claim 5, wherein at least one hidden pocket is arranged on the left curtain or the right curtain; the at least one hidden pocket is opened and closed through a fourth zipper; a net pocket is arranged adjacent to the at least one hidden pocket.

10. The suitcase with the garment bag according to claim 1, wherein the suitcase body further comprises a pulling rod and universal wheels; the pulling rod is installed on one side of the suitcase cover; the universal wheels are installed at a bottom portion of the suitcase body; a combination lock is arranged on another side of the suitcase body.

11. The suitcase with the garment bag according to claim 4, wherein the suitcase body further comprises a pulling rod and universal wheels; the pulling rod is installed on one side of the suitcase cover; the universal wheels are installed at a bottom portion of the suitcase body; a combination lock is arranged on another side of the suitcase body.

12. The suitcase with the garment bag according to claim 7, wherein the suitcase body further comprises a pulling rod and universal wheels; the pulling rod is installed on one side of the suitcase cover; the universal wheels are installed at a bottom portion of the suitcase body; a combination lock is arranged on another side of the suitcase body.

* * * * *